US007821877B2

(12) United States Patent
Sakamaki et al.

(10) Patent No.: US 7,821,877 B2
(45) Date of Patent: Oct. 26, 2010

(54) POINTER INDICATION TYPE TIMEPIECE

(75) Inventors: Shin-ichi Sakamaki, Nishitokyo (JP); Kazuo Sakamoto, Nishitokyo (JP); Masanori Katayama, Nishitokyo (JP)

(73) Assignee: Citizen Holdings Co., Ltd., Nishitokyo-Shi, Tokyo (JP)

( * ) Notice: Subject to any disclaimer, the term of this patent is extended or adjusted under 35 U.S.C. 154(b) by 450 days.

(21) Appl. No.: 11/795,885

(22) PCT Filed: Feb. 21, 2006

(86) PCT No.: PCT/JP2006/303043

§ 371 (c)(1),
(2), (4) Date: Jul. 24, 2007

(87) PCT Pub. No.: WO2006/090694

PCT Pub. Date: Aug. 31, 2006

(65) Prior Publication Data

US 2009/0154301 A1 Jun. 18, 2009

(30) Foreign Application Priority Data

Feb. 22, 2005 (JP) ..... 2005-045706

(51) Int. Cl.
*G04B 19/04* (2006.01)

(52) U.S. Cl. ..... 368/80; 368/220; 368/228

(58) Field of Classification Search ..... 368/223, 368/228, 80, 314, 220–222
See application file for complete search history.

(56) References Cited

U.S. PATENT DOCUMENTS

| | | | | | |
|---|---|---|---|---|---|
| 3,903,686 | A | * | 9/1975 | Burki | 368/106 |
| 3,967,147 | A | * | 6/1976 | Preiser et al. | 310/162 |
| 4,079,582 | A | * | 3/1978 | Tamaru et al. | 368/204 |
| 4,243,329 | A | * | 1/1981 | Nakayama | 368/76 |
| 4,447,163 | A | * | 5/1984 | Tsukada et al. | 368/319 |
| 4,692,031 | A | * | 9/1987 | Kaneko et al. | 368/18 |
| 4,731,767 | A | * | 3/1988 | Uehara | 368/15 |

FOREIGN PATENT DOCUMENTS

| | | |
|---|---|---|
| DE | 72 02 669 U | 4/1972 |
| DE | 72 02 671 U | 4/1972 |
| JP | S57-201983 | 6/1981 |
| JP | H01-168893 | 11/1989 |
| JP | H04-102089 | 9/1992 |
| JP | H08-9656 | 3/1996 |
| JP | 2001-074857 | 3/2001 |

* cited by examiner

*Primary Examiner*—Vit W Miska
*Assistant Examiner*—Sean Kayes
(74) *Attorney, Agent, or Firm*—Manabu Kanesaka

(57) ABSTRACT

A pointer indication type timepiece, wherein three projecting portions (11) projecting from a shaft part (112) to an outer peripheral side and formed in such a shape that a cylinder is split into two parts along a central axis direction are disposed at a root portion (113) of the shaft part (112) of an hour wheel (110) at equal intervals in the circumferential direction of the shaft part (112). The projecting portions (11) engage with a circular hole (123) in a dial washer (120).

23 Claims, 10 Drawing Sheets

(a)

(b)

(a)

(b)

(a)

(b)

(a)

(b)

(a)

(b)

(a)

(b)

(a)

(b)

(a)

(b)

POINTER INDICATION TYPE TIMEPIECE

TECHNICAL FIELD

The present invention relates to a pointer indication type timepiece, and more particularly, it relates to a pointer indication type timepiece in which regulation members for regulating the axial movement of a dial washer are provided in parts of a shaft part of an hour wheel to prevent the detachment of the dial washer from the shaft part.

BACKGROUND ART

Recently, it has become more common for pointer indication type wristwatches to be manufactured through automatic assembly by an assembling machine. Since the automatic assembly has reduced the manufacturing costs of movements of timepieces, the sale of the timepiece movements alone has become more general in the timepiece industry. As a timepiece movement, there is, for example, a timepiece movement shown in FIGS. 1 and 3 of Patent document 1, part of which is shown in FIG. 9.

FIRST CONVENTIONAL EXAMPLE

FIG. 9 shows a schematic sectional view of essential parts to explain a timepiece movement according to a first conventional example.

In FIG. 9, a timepiece movement 100 comprises an hour wheel 110 made of a resin in which a wheel gear part 111 and a shaft part 112 are integrally molded, and a dial washer 120 which urges the wheel gear part 111 of the hour wheel 110 toward a main plate 140 to prevent the inclination of the shaft part 112 when this dial washer 120 is inserted into the shaft part 112 and a dial 130 is attached to the dial washer 120 (e.g., refer to Patent document 1).

In addition, although not shown in the drawing, the timepiece movement 100 has an hour hand attached to the shaft part 112 of the hour wheel 110, a minute hand attached to a center wheel & pinion 160, and a seconds hand attached to a seconds wheel & pinion 150.

FIG. 10 is a schematic diagram to explain the dial washer of the timepiece movement according to the first conventional example, wherein (a) shows a plan view, and (b) shows an X-X sectional view.

In FIG. 10, the dial washer 120 has a structure in which a circular ring shaped flat plate made of an elastic material such as a metal is bent using an arbitrary diametric linear portion 121 as a bottom. When a circular hole 123 of this dial washer 120 is inserted into the shaft part 112, the bottom contacts the wheel gear part 111, and an outer peripheral edge 122 located uppermost contacts the dial 130. Further, the resilience produced when the outer peripheral edge 122 is depressed by the dial 130 urges the wheel gear part 111 toward the main plate 140.

FIG. 11 shows a schematic sectional view to explain how the dial washer is inserted in the shaft part in the timepiece movement according to the first conventional example.

In FIG. 11, the dial washer 120 is inserted in the shaft part 112. Here, the dial washer 120 is smoothly inserted into the shaft part 112 because an inside diameter d of the circular hole 123 of the dial washer 120 is greater than an outside diameter D of the shaft part 112, so that no problem occurs such as scratching of the outer peripheral surface of the shaft part 112, but there is a disadvantage that they are easily detached from each other.

When the timepiece movement 100 is assembled as shown in FIG. 9, the wheel gear part 111 is pressed onto the main plate 140 by the resilience of the dial washer 120, and the inclination of the shaft part 112 can be prevented. Thus, the hour hand (not shown) attached to the tip of the shaft part 112 can be prevented from touching the dial or the minute hand due to tilting, such that the thickness of the timepiece can be reduced.

Meanwhile, when the timepiece movement alone is sold or conveyed, unnecessary time is produced in a task of a subsequent process if a component of the timepiece movement drops. Therefore, a separate sending method has been employed in which the hour wheel and the dial washer are packed separately without installing them in the timepiece movement. However, they have to be installed in the timepiece movement when the timepiece movement is cased, resulting in poor manufacturing efficiency. It is also necessary to prevent the hour wheel and the dial washer from dropping when the timepiece movement is conveyed in the process of assembling the timepiece.

Therefore, for example, there has been employed a method in which the hour wheel and the dial washer are removed from the timepiece movement, separately packed, and then appended to the timepiece movement for carriage. However, manufacturing efficiency is poor in this method because components that can be automatically assembled have to be separately conveyed. Thus, various techniques have been developed to prevent the hour wheel, the dial washer and so on from dropping, and there is, for example, a technique shown in FIG. 12.

SECOND CONVENTIONAL EXAMPLE

FIG. 12 is a schematic diagram of essential parts to explain a timepiece movement according to a second conventional example, wherein (a) shows a plan view, and (b) shows a side view.

In FIG. 12, a timepiece movement 200 comprises an hour wheel 210 made of a resin in which an axle part 212 is projectively provided, and a dial washer 220 which grips and fixes the axle part 212 and which has protruding parts 222 provided in an inner peripheral part of a central hole 221 (e.g., refer to Patent document 2). In this manner, it is possible to avoid a problem such as the detachment of the dial washer 220 from the axle part 212 in a conveyance process or an assembly process. Moreover, tilting of the pointers (not shown) attached to the tip of the hour wheel 210 can be prevented, such that the thickness of the timepiece can be reduced.

Patent document 1: Japanese Patent Publication Laid-open No. 2001-74857

Patent document 2: Japanese Patent Publication Laid-open No. 2002-207086

However, the timepiece movement 200 according to the second conventional example has a problem that the surface of the axle part 212 is scratched because the protruding parts 222 of the dial washer 220 descends while scraping against the outer peripheral surface of the axle part 212 when the dial washer 220 is mounted. That is, the scratching can produce flash and chips, and the presence of such foreign objects inside the timepiece is an extremely serious problem in terms of quality control. That is, the production of the foreign objects needs to be prevented because even a small amount of foreign objects can cause the timepiece to stop.

Furthermore, for example, assuming that the dial washer 220 in the second conventional example is inserted into the shaft part 112 of the hour wheel 110 in the first conventional example to which the hour hand is attached, the tip of the shaft part 112 into which the hour hand (not shown) is loaded is scratched, leading to a problem that the force to fix the hour hand is reduced.

Moreover, it is generally extremely difficult to form the small protruding parts 222 in the dial washer 220 made of a metal thin plate, so that there has been a problem that the required accuracy of the protruding parts 222 can be not maintained.

Still further, when the inside diameter d of the circular hole 123 is made smaller than the outside diameter D of the shaft part 112 so that the dial washer 120 is attached in an interference fit state, the upward curve (bent state) of the dial washer 120 is inhibited, and the spring force (resilience) of the dial washer 120 varies, and moreover, the axial movement of the hour wheel 110 can not be stably controlled, leading to a problem that the deflection of handles can not be reduced.

The present invention has been proposed to solve the problems as described above pertaining to the conventional techniques, and is directed to provide a pointer indication type timepiece which prevents a dial washer from dropping before the attachment of a dial and suppresses the production of foreign objects and which ensures the fixing of pointers and which can avoid, for example, a problem that the deflection of handles can not be reduced due to the varying spring force of the dial washer.

DISCLOSURE OF THE INVENTION

In order to achieve the above-mentioned object, a pointer indication type timepiece of the present invention comprises: an hour wheel having a shaft part to which pointers are attached and a wheel gear part; and a dial washer having a hole part through which the shaft part of the hour wheel is inserted, wherein regulation members which regulate the axial movement of the dial washer are provided in parts of the hour wheel.

Thus, the regulation members inhibit the axial movement of the dial washer, so that the dial washer can be prevented from dropping from the hour wheel.

In addition, the hour wheel means a spring washer for use in a wristwatch which is inserted into the shaft part and which urges the wheel gear part of the hour wheel toward a main plate to prevent the inclination of the shaft part when a dial is attached.

Furthermore, in the present invention, the regulation members are one or more projecting portions projecting from the shaft part to an outer peripheral side.

Thus, the dial washer can be efficiently regulated by use of the projecting portions.

Furthermore, in the present invention, the projecting portion is provided to extend from the top of the surface of the wheel gear part of the hour wheel to an axially upper portion of the shaft part, and the projecting portion engages with the hole part of the dial washer.

Thus, the projecting portions simply engage with the hole part of the dial washer so that the dropping of the dial washer can be prevented.

Furthermore, in the present invention, the projecting portion is provided below a pointer attachment position of the shaft part.

Thus, the projecting portion does not cause an obstruction during the attachment of the pointers, and it is possible to avoid the problem that the pointers scrape against the regulation members to produce foreign objects.

Furthermore, in the present invention, a tapered part is formed at the top of the projecting portion.

Thus, the dial washer can be smoothly loaded in.

Furthermore, in the present invention, the inside diameter of the hole part of the dial washer is greater than the outside diameter of the pointer attachment position of the shaft part and smaller than the diameter of a hypothetical circle of the projecting portions.

Thus, the dial washer can be easily mounted on the hour wheel, and it is possible to ensure that the dial washer is fixed by the regulation members.

Furthermore, in the present invention, three or more odd projecting portions are provided and arranged at equal intervals.

Thus, three or more odd regulation members are provided and arranged at equal intervals, such that the regulation members are not provided at positions opposite to each other 180 degrees, thereby making it easy to install the dial washer in the hour wheel. Further, since the upward curve of the dial washer is not inhibited, the variation of the spring force of the dial washer is reduced, and the axial movement of the hour wheel can be suppressed to reduce the deflection of the handles.

Furthermore, in the present invention, the projecting portions are formed at positions separate from the upper surface of the wheel gear part of the shaft part.

Thus, the upward curve of the dial washer is not inhibited, such that the variation of the spring force of the dial washer can be suppressed.

Furthermore, in the present invention, the inside diameter of the hole part of the dial washer is greater than the outside diameter of the shaft part and smaller than the diameter of a hypothetical circle of the projecting portions, such that the dial washer idly engages with the shaft part between the projecting portion and the wheel gear part beyond the projecting portion.

Thus, the dial washer idly engages with the shaft part, and the upward curve of the dial washer is not inhibited, such that the spring force of the dial washer does not vary, and it is possible to ensure that the axial movement of the hour wheel can be suppressed to reduce the deflection of the handles.

Furthermore, in the present invention, the projecting portion has a first projecting portion projecting from the surface of the shaft part, and a second projecting portion further projecting from the surface of the first projecting portion.

Thus, when the dial washer is inserted into the shaft part, the dial washer can be smoothly inserted into the shaft part because a space between the shaft part without the projecting portions and the hole part of the dial washer can be increased.

Furthermore, in the present invention, the first projecting portion and the second projecting portion are provided below a pointer attachment position of the shaft part.

Thus, the first projecting portion and the second projecting portion do not cause an obstruction during the attachment of the pointers, and it is possible to avoid the problem that the pointers scrape against the regulation members to produce foreign objects.

Furthermore, in the present invention, tapered parts are formed at the tops of the first projecting portion and/or the second projecting portion.

Thus, the dial washer can be smoothly loaded in.

Furthermore, in the present invention, a slope part is provided at the bottom of the second projecting portion.

Thus, formability in a molding die can be improved.

Furthermore, in the present invention, the inside diameter of the hole part of the dial washer is greater than the diameter of the hypothetical circle of the first projecting portions and smaller than the diameter of the hypothetical circle of the second projecting portions.

Thus, the dial washer can be easily mounted on the hour wheel, and it is possible to ensure that the dial washer is fixed by the regulation members.

Furthermore, in the present invention, three or more odd first projecting portions and three or more odd second projecting portions are provided and arranged at equal intervals.

Thus, three or more odd regulation members are provided and arranged at equal intervals, such that the regulation members are not provided at positions opposite to each other 180 degrees, thereby making it easy to install the dial washer in the hour wheel. Further, since the upward curve of the dial washer is not inhibited, the variation of the spring force of the dial washer is reduced, and the axial movement of the hour wheel can be suppressed to reduce the deflection of the handles.

Furthermore, in the present invention, the regulation members are hooks provided on the upper surface of the wheel gear part of the hour wheel, and the hooks lock parts of the dial washer.

Thus, when the regulation members are hooks, the dial washer can also be easily mounted on the hour wheel, and it is possible to ensure that the dial washer is fixed by the regulation members.

Furthermore, in the present invention, the hooks are provided at least two places opposite to each other across the shaft part.

Thus, the dial washer can be fixed simply by locking this dial washer to the hooks at least two places opposite to each other across the shaft part.

Furthermore, in the present invention, parts of the outer periphery of the dial washer are locked to the hooks.

Thus, the outer periphery of the dial washer can be easily locked.

Furthermore, in the present invention, the dial washer is bent using an arbitrary diametric linear portion as a bottom, and positions at which the bottom intersects with the outer periphery are locked by the hooks.

Thus, when the dial washer is bent, the dial washer can have a great amount of spring characteristics, and the dial washer can be fixed at the bottom of the bent surface, such that the dial washer is firmly fixed. Moreover, since the upward curve of the dial washer is not inhibited, the variation of the spring force of the dial washer is reduced, and the axial movement of the hour wheel can be suppressed to reduce the deflection of the handles.

Furthermore, in the present invention, the regulation members are adhesive members provided on the upper surface of the wheel gear part of the hour wheel, and the dial washer is fixed to the adhesive members.

Thus, when the regulation members are adhesive members, the dial washer can be fixed simply by attaching this dial washer to the hour wheel and pressing the dial washer onto the adhesive members.

Furthermore, in the present invention, the adhesive members are provided at least two places opposite to each other across the shaft part.

Thus, the dial washer can be fixed simply by the force of adhesion to the adhesive members at least two places opposite to each other across the shaft part.

Furthermore, in the present invention, the dial washer is bent using an arbitrary diametric linear portion as a bottom, and two places of the bottom are in contact with the adhesive members.

Thus, when the dial washer is bent, the dial washer can have a great amount of spring characteristics, and the dial washer can be fixed at the bottom of the bent surface, such that the dial washer is firmly fixed. Moreover, since the upward curve of the dial washer is not inhibited, the variation of the spring force of the dial washer is reduced, and the axial movement of the hour wheel can be suppressed to reduce the deflection of the handles.

Furthermore, in the present invention, the hour wheel is made of a resin, such that the regulation members can be easily processed in the hour wheel.

Furthermore, in the present invention, the dial washer is made of a metal, such that the dial washer can have a sufficient amount of spring characteristics. Moreover, the spring characteristics vary in only a small amount even if an environment including the temperature, humidity and so on changes. For example, when the dial washer is made of a resin, the spring force decreases and is not restored in some cases, and the metal makes it possible to avoid such a problem.

Still further, in order to achieve the above-mentioned object, a pointer indication type timepiece of the present invention comprises: an hour wheel having a shaft part to which pointers are attached and a wheel gear part; and a dial washer having a hole part through which the shaft part of the hour wheel is inserted, wherein regulation members including projecting portions which regulate the axial movement of the dial washer are provided in parts of the hour wheel; and the projecting portion has a first projecting portion projecting from the surface of the shaft part, and a second projecting portion further projecting from the surface of the first projecting portion, the first projecting portion being formed to extend from the bottom surface of the second projecting portion to the top of the surface of the wheel gear part.

Thus, the regulation members inhibit the axial movement of the dial washer, so that the dial washer can be prevented from dropping from the hour wheel. Moreover, when the dial washer is inserted into the shaft part, the dial washer can be smoothly inserted into the shaft part because a space between the shaft part without the projecting portions and the hole part of the dial washer can be increased.

Furthermore, in the present invention, the inside diameter of the hole part of the dial washer is greater than the diameter of a hypothetical circle of the first projecting portions and smaller than the diameter of a hypothetical circle of the second projecting portions.

Thus, the dial washer can be easily mounted on the hour wheel, and it is possible to ensure that the dial washer is fixed by the regulation members.

Furthermore, in the present invention, tapered parts are formed at the tops of the first projecting portion and/or the second projecting portion, and a slope part is provided at the bottom of the second projecting portion.

Thus, the dial washer can be smoothly inserted into the projecting portions, and the dial washer can be easily attached and detached. Moreover, formability in a molding die can be improved.

According to the pointer indication type timepiece of the present invention, the dial washer can be prevented from dropping before the attachment of a dial, the production of foreign objects can be suppressed, the fixing of pointers can be ensured without damaging the pointer attachment position, and it is possible to avoid, for example, a problem that the deflection of handles can not be reduced due to the varying spring force of the dial washer.

BEST MODE FOR CARRYING OUT THE INVENTION

First Embodiment

A first embodiment of the present invention will hereinafter be described with reference to the drawings.

Figure 1:
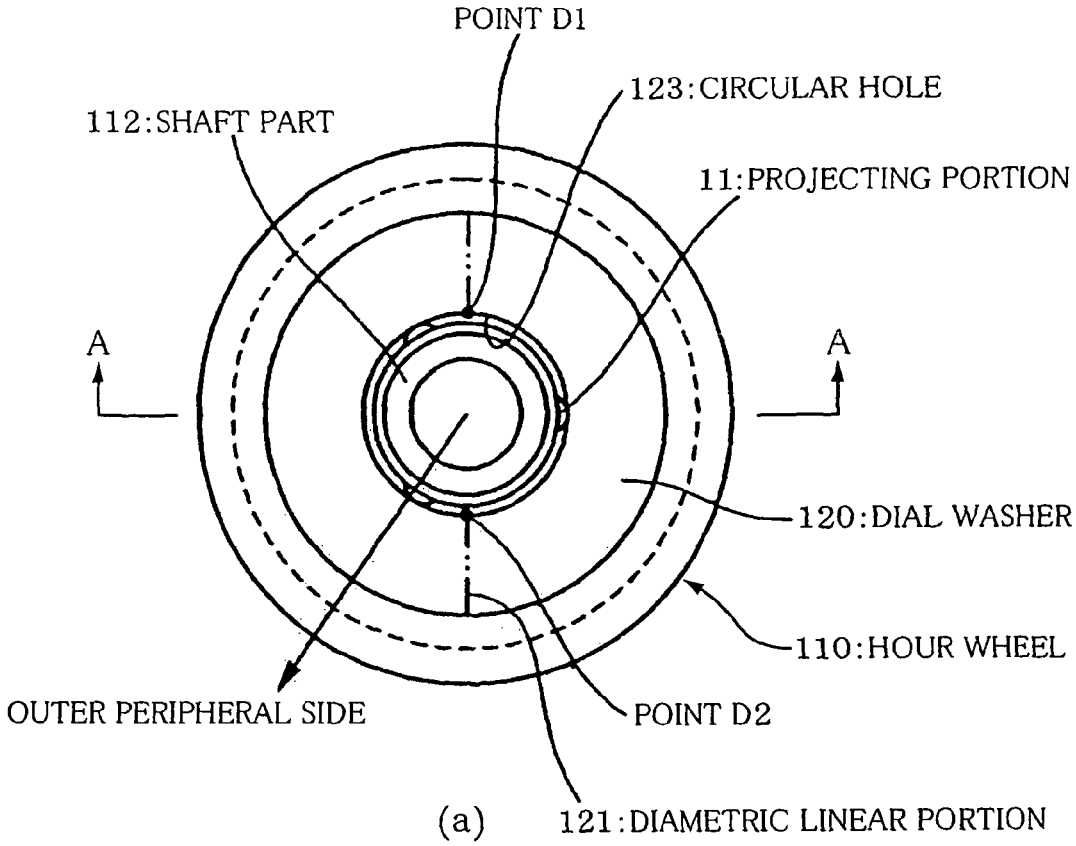
FIG. 1 is a schematic diagram of essential parts of a pointer indication type timepiece according to a first embodiment of the present invention, wherein (a) shows a plan view, and (b) shows an A-A sectional view.
Figure 1:
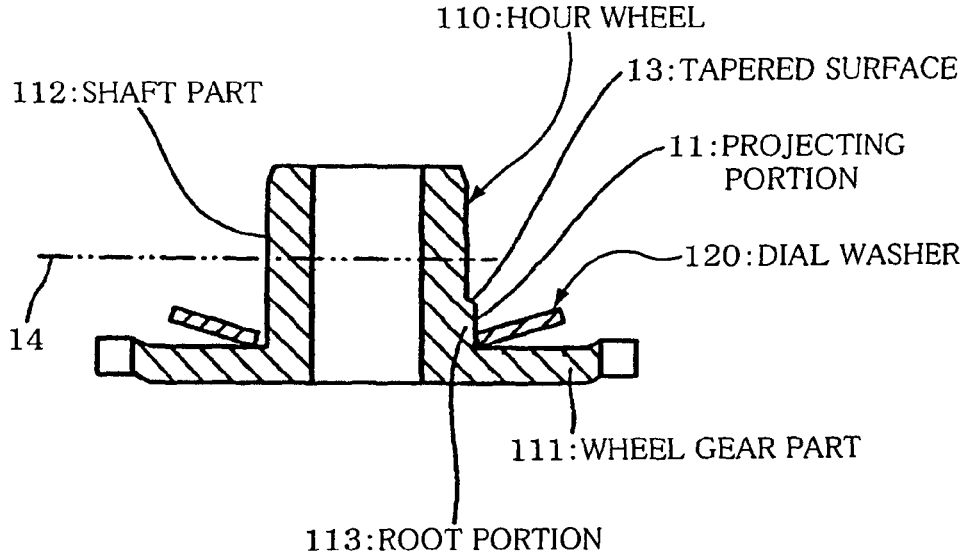

FIG. 1 is a schematic diagram of essential parts of a pointer indication type timepiece according to a first embodiment of the present invention, wherein (a) shows a plan view, and (b) shows an A-A sectional view.

In FIG. 1, the pointer indication type timepiece in the present embodiment is different from the pointer indication type timepiece in the first conventional example in that projecting portions 11 as regulation members are provided in parts of an hour wheel 110 (a root portion 113 of a shaft part 112 in the present embodiment). Other components are substantially similar to those in the first conventional example.

Figure 9:
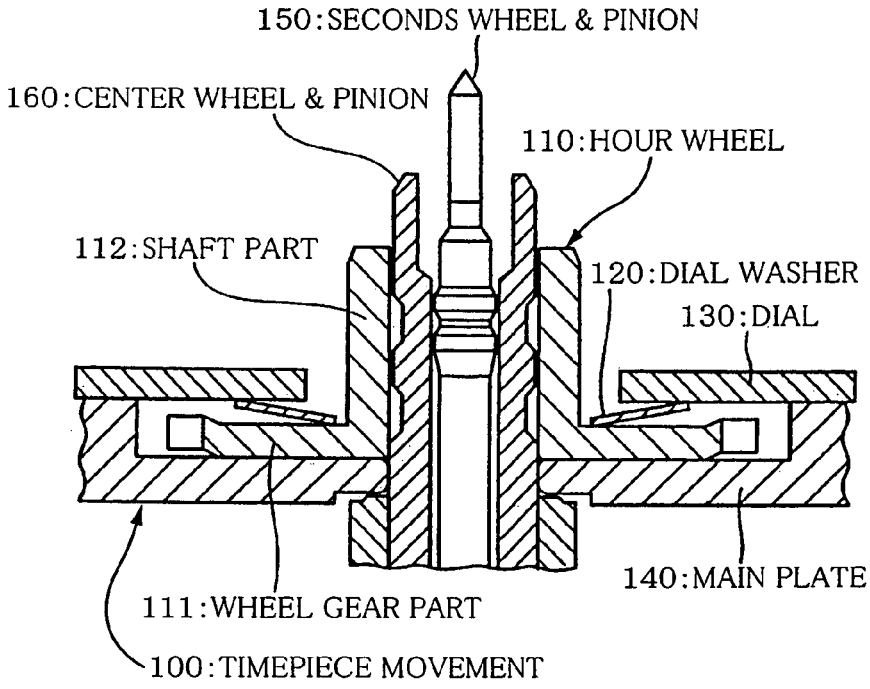
FIG. 9 shows a schematic sectional view of essential parts to explain a timepiece movement according to a first conventional example.
Figure 10:
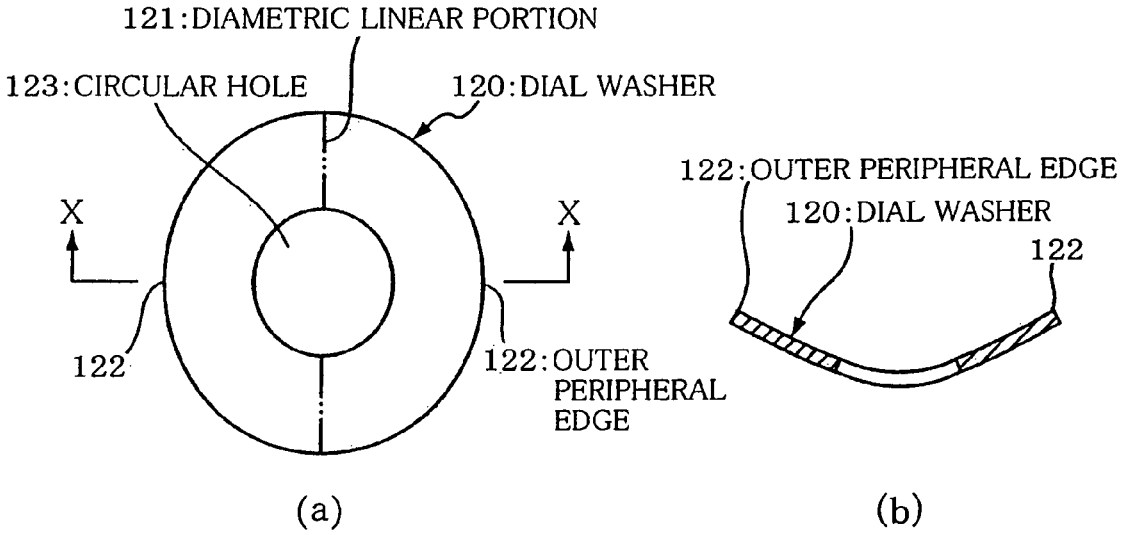
FIG. 10 is a schematic diagram to explain a dial washer of the timepiece movement according to the first conventional example, wherein (a) shows a plan view, and (b) shows an X-X sectional view.
Figure 11:
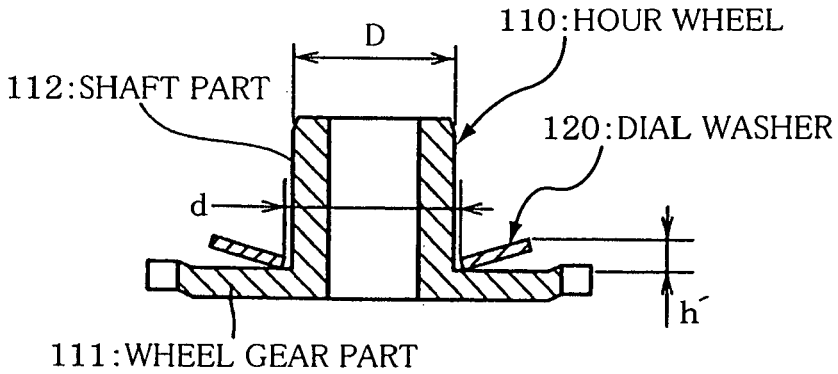
FIG. 11 shows a schematic sectional view to explain how the dial washer is inserted in a shaft part in the timepiece movement according to the first conventional example.
Figure 12:
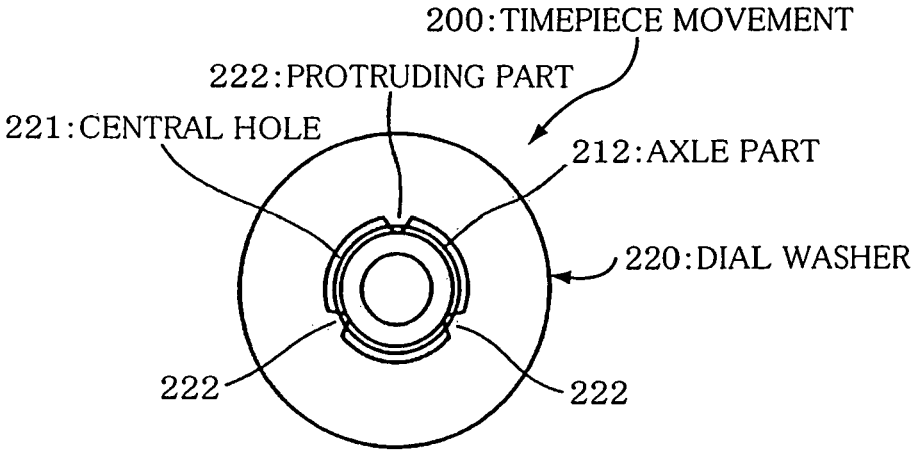
FIG. 12 is a schematic diagram of essential parts to explain a timepiece movement according to a second conventional example, wherein (a) shows a plan view, and (b) shows a side view.
Figure 12:
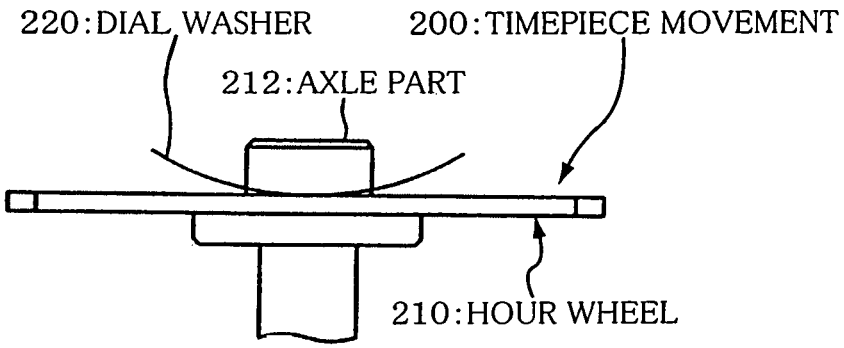

Therefore, in FIG. 1, the same signs are assigned to the components similar to those in FIGS. 9, 10 and 11, and these components are not described in detail.

The projecting portion 11 projects from the shaft part 112 to an outer peripheral side and has a semicircular shape, and the projecting portions 11 engage with a circular hole 123 of a dial washer 120. Here, the engagement means that the dial washer 120 is fitted into the projecting portions 11 so that the dial washer 120 is not easily detached from the shaft part 112, and the dial washer 120 is generally fitted in an interference fit state or in a loose fit state. Thus, the projecting portions 11 function as regulation members for regulating an axial movement, and can regulate the axial movement of the dial washer 120 simply by engaging the projecting portions 11 with the circular hole 123 of the dial washer 120 having an ordinary (conventional) shape, thereby making it possible to prevent the dial washer 120 from dropping from the hour wheel 110.

Here, a tapered surface 13 as a tapered part is preferably formed at the top of the projecting portion 11, in which case the dial washer 120 can be smoothly fitted in. Further, when the dial washer 120 is smoothly fitted in, the production of foreign objects such as flash, chips and so on can be suppressed.

Moreover, the hour wheel 110 is made of a resin, such that even the hour wheel 110 having the projecting portions 11 can be accurately and easily processed.

In addition, the projecting portion 11 of the present embodiment has a cylindrical shape split into two parts, but is not limited to this shape. Moreover, the height of the projecting portion 11 has only to be a height necessary for the engagement of the dial washer 120, for example, a height several times (two to six times) the thickness of the dial washer 120. The height of the projecting portion 11 is not unnecessarily large, such that the production of foreign objects can be suppressed.

Since the projecting portions 11 are provided below a pointer attachment position (in general, the tip of the shaft part 112) of the shaft part 112, that is, provided at a position where the projecting portions 11 do not interfere with pointers (not shown), it is possible to avoid a problem that the pointers scrape against the projecting portions 11 to produce foreign objects during the attachment of the pointers. Further, in the present embodiment, the projecting portion 11 is provided to extend from the top of the surface of a wheel gear part 111 of the hour wheel 110 to an axially upper portion of the shaft part 112, so that the projecting portions 11 can fix the dial washer 120 at the root portion 113 of the shaft part 112 of the hour wheel 110 where the dial washer 120 is generally located.

Furthermore, since the projecting portion 11 is provided closer to the surface of the wheel gear part 111 than the center 14 of the axial direction of the shaft part 112, the projecting portions 11 do not cause an obstruction in the attachment of the pointers when an hour hand (not shown) is installed in the hour wheel 110, so that it is possible to ensure that the hour hand can be easily attached to the hour wheel.

Three projecting portions 11 are provided at equal intervals in the circumferential direction of the shaft part 112. Thus, when three or more odd projecting portions 11 are provided and arranged at equal intervals, the projecting portions 11 are not provided at positions opposite to each other 180 degrees, such that two points $D_1$ and $D_2$ where the circular hole 123 intersects with the diametric linear portion 121 do not simultaneously engage with the projecting portions 11. For example, although not shown in the drawings, the dial washer 120 is stretched in the direction of the diametric linear portion 121 if the two points $D_1$ and $D_2$ engage with the projecting portions 11, so that the upward curve (bent state) of the dial washer 120 is inhibited, the axial movement of the hour wheel 110 can not be stably suppressed, and the deflection of handles can not be reduced. That is, in the present embodiment, three projecting portions 11 are provided at equal intervals in the circumferential direction of the shaft part 112, such that the upward curve of the dial washer is normally maintained, the variation of the spring force of the dial washer 120 is reduced, and the axial movement of the hour wheel 110 can be suppressed to reduce the deflection of the handles. Moreover, since the two points $D_1$ and $D_2$ do not simultaneously engage with the projecting portions 11 when the dial washer 120 is installed, it is not necessary to operate paying attention to a positional relation with the projecting portions 11, and the dial washer 120 can be easily installed in the hour wheel 110.

In addition, while three projecting portions 11 are provided in the present embodiment, three or more odd projecting portions 11 may be provided and arranged at equal intervals.

Figure 2:
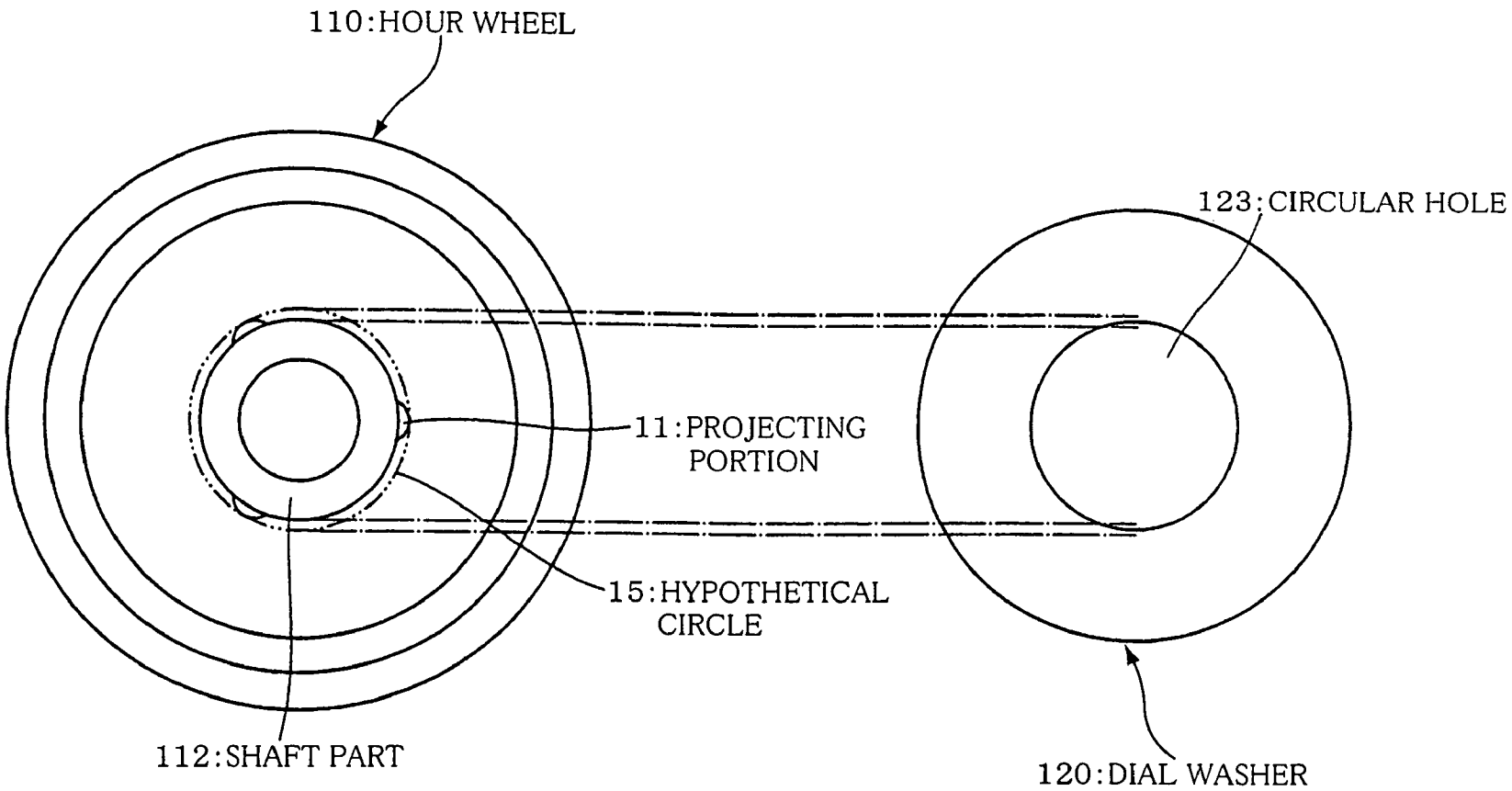
FIG. 2 shows a schematic enlarged plan view to explain a dial washer of the pointer indication type timepiece according to the first embodiment of the present invention.

FIG. 2 shows a schematic enlarged plan view to explain the dial washer of the pointer indication type timepiece according to the first embodiment of the present invention.

In FIG. 2, the inside diameter of the circular hole 123 of the dial washer 120 is greater than the outside diameter of the shaft part 112 and smaller than the diameter of a hypothetical circle 15 which passes a position where the three projecting portions 11 contact the circular hole 123. Thus, the dial washer 120 can be easily mounted on the hour wheel 110, and it is possible to ensure that the dial washer 120 is fixed by the projecting portions 11.

In addition, in the present embodiment, the pointer attachment portion is the tip of the substantially cylindrical shaft part 112, so that the inside diameter of the circular hole 123 is greater than the outside diameter of the shaft part 112. However, for example, when the pointer attachment portion is not cylindrical, the inside diameter of the circular hole 123 can be made greater than the outside diameter of the pointer attachment portion of the shaft part 112.

Furthermore, since the inside diameter of the circular hole 123 of the dial washer 120 is greater than the outside diameter of the shaft part 112, there is caused no such problem that the pointer attachment portion of the shaft part 112 is scratched during insertion, and the hour hand can be fixed with normal fixation force.

Moreover, since the center point (not shown) of the dial washer 120 engaged with the projecting portions 11 coincides with the center point (not shown) of the hour wheel 110, the dial washer 120 is prevented from being eccentric with respect to the shaft part 112 or moving due to its unsettled position, and the dial washer 120 slides while an outer peripheral edge 122 and a dial 130 are in a stable state. Thus, it is possible to reduce the risk of producing foreign objects such as abrasion powder, and so on.

Here, the dial washer 120 is preferably made of a metal, such that the dial washer 120 can have a sufficient amount of spring characteristics. Further, the dial washer 120 made of a metal has an advantage that its spring characteristics vary in only a small amount even if an environment including the temperature, humidity and so on changes. In addition, when the dial washer 120 is made of, for example, a resin, the spring force decreases and is not restored in some cases, and the metal makes it possible to avoid such a problem.

According to the pointer indication type timepiece having such a configuration, the dial washer 120 can be prevented from dropping before the attachment of the dial 130, the production of foreign objects can be suppressed, the fixing of the pointers can be ensured without damaging the pointer attachment position, and it is possible to avoid a problem that the deflection of handles can not be reduced due to the varying spring force of the dial washer 120.

Figure 3:
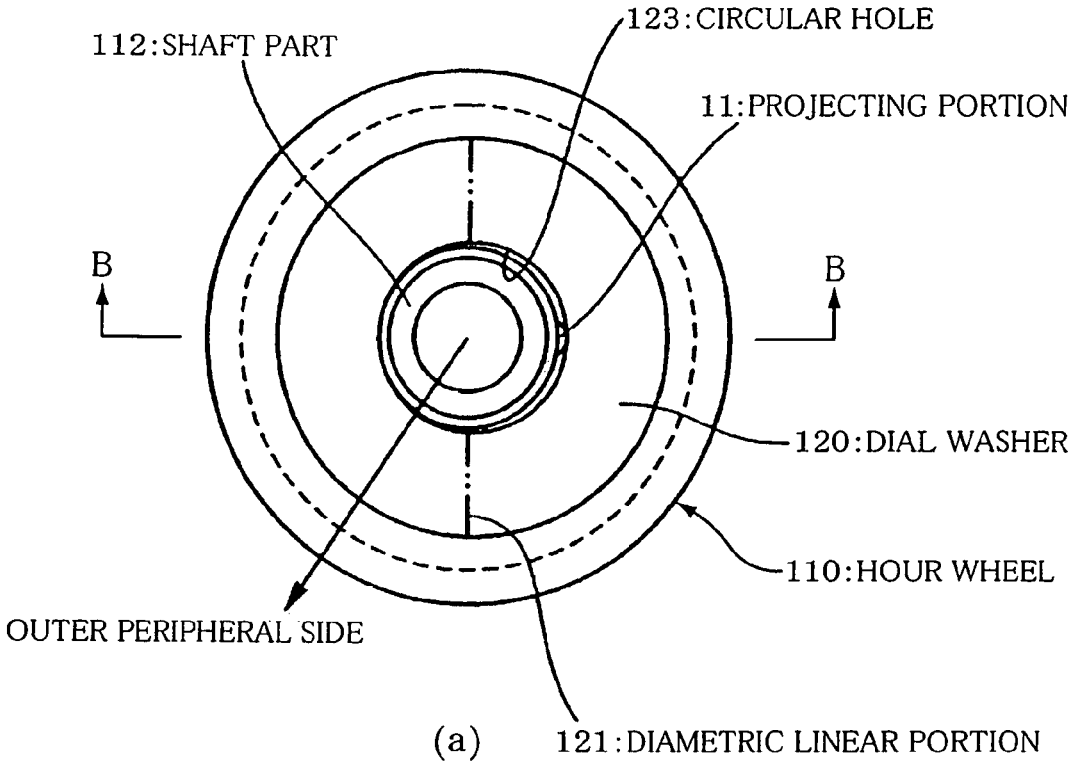
FIG. 3 is a schematic diagram of essential parts of a pointer indication type timepiece according to an application of the first embodiment of the present invention, wherein (a) shows a plan view, and (b) shows a B-B sectional view.
Figure 3:
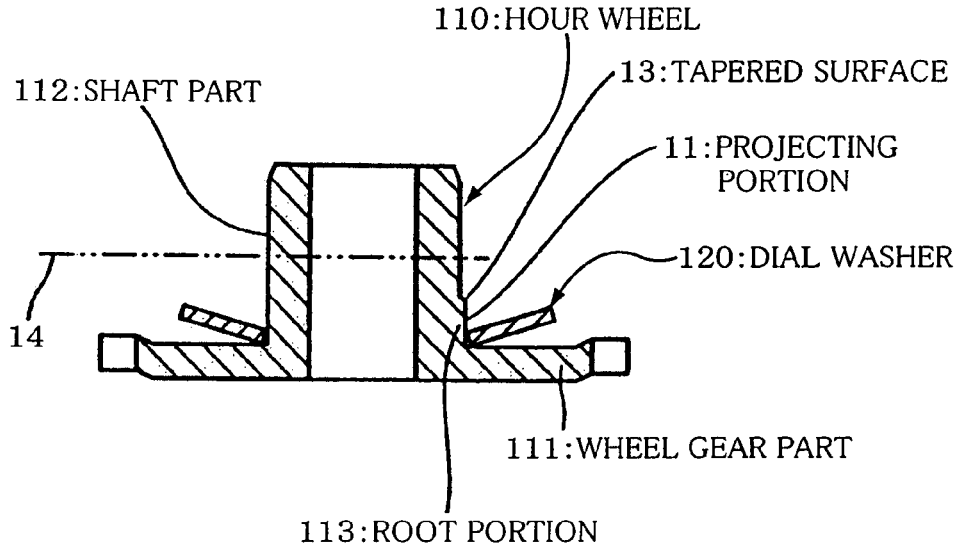

In addition, while the projecting portions 11 as the regulation members are provided at three places in the embodiment described above, the present invention is not limited to this configuration. For example, one projecting portion 11 may be provided as shown in FIG. 3. Thus, the projecting portion 11 and the side of the shaft part 112 opposite to the projecting portion 11 engage with the circular hole 123 of the dial washer 120, and the dial washer 120 can be prevented from dropping with a simple configuration. Moreover, when the dial washer 120 is inserted into the shaft part 112, the dial washer 120 can be smoothly inserted until this dial washer 120 contacts the projecting portion 11, so that the production of foreign objects can be suppressed, and the fixing of the pointers can be ensured without damaging the pointer attachment position.

Second Embodiment

A second embodiment of the present invention will hereinafter be described with reference to the drawings.

Figure 4:
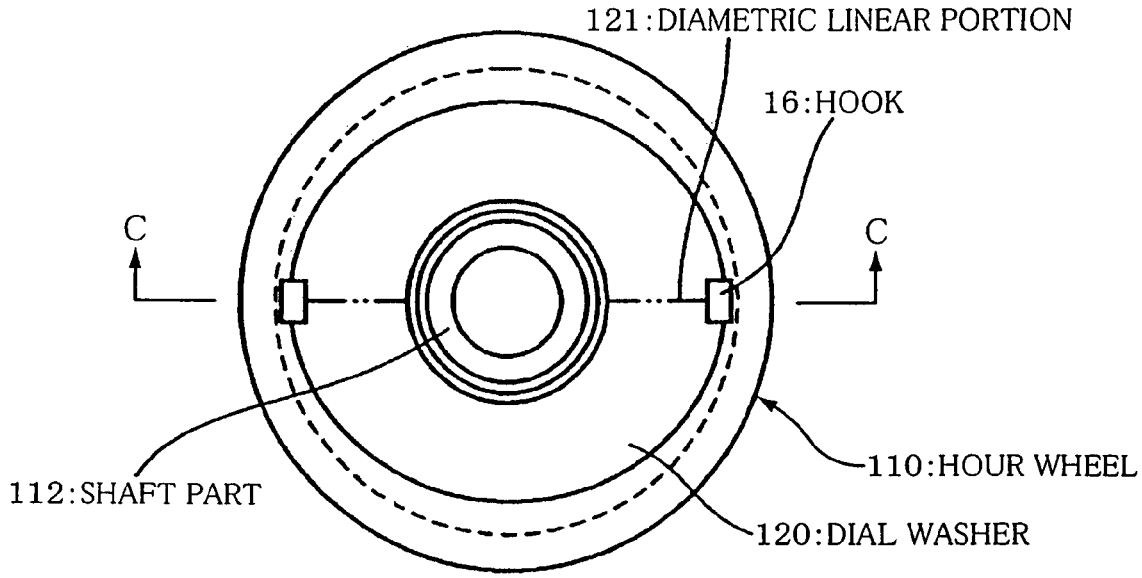
FIG. 4 is a schematic diagram of essential parts of a pointer indication type timepiece according to a second embodiment of the present invention, wherein (a) shows a plan view, and (b) shows a C-C sectional view.
Figure 4:
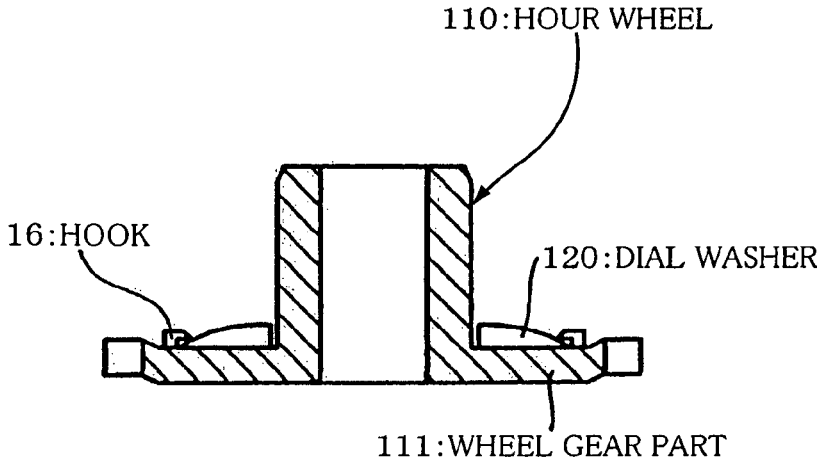

FIG. 4 is a schematic diagram of essential parts of a pointer indication type timepiece according to a second embodiment of the present invention, wherein (a) shows a plan view, and (b) shows a C-C sectional view.

In FIG. 4, the pointer indication type timepiece in the present embodiment is different from the pointer indication type timepiece in the first conventional example in that a pair of hooks 16 for engaging a dial washer 120 is provided on the upper surface of a wheel gear part 111 of an hour wheel 110. Other components are substantially similar to those in the first conventional example.

Therefore, in FIG. 4, the same signs are assigned to the components similar to those in FIGS. 9, 10 and 11, and these components are not described in detail.

The hooks 16 are regulation members for regulating the axial movement of the dial washer 120, and locks the outer periphery of the dial washer 120 in the direction of a diametric linear portion 121. Thus, when the regulation members are the hooks 16, the dial washer 120 can also be easily mounted on the hour wheel 110, and it is possible to ensure that the dial washer 120 is fixed by the hooks 16.

Furthermore, the hooks 16 are provided at two places opposite to each other across a shaft part 112, such that the dial washer 120 can be fixed by locking this dial washer 120 to the hooks 16 at two places.

As described above, the dial washer 120 is bent using the arbitrary diametric linear portion 121 as a bottom, and positions at which the bottom intersects with the outer periphery are locked by the hooks 16. Thus, when the dial washer 120 is bent, the dial washer 120 can have a great amount of spring characteristics, and the dial washer 120 can be fixed at the bottom of the bent surface, such that the dial washer 120 is firmly fixed. Moreover, since the upward curve of the dial washer 120 is not inhibited, the variation of the spring force of the dial washer 120 is reduced, and the axial movement of the hour wheel 110 can be suppressed to reduce the deflection of handles.

Thus, according to the pointer indication type timepiece in the present embodiment, the hooks 16 are provided on the upper surface of the wheel gear part 111 of the hour wheel 110, such that the dial washer 120 can be prevented from dropping. Moreover, the production of foreign objects is suppressed, and the fixing of the pointers can be ensured without damaging a pointer attachment position. Further, it is possible to avoid a problem that the deflection of the handles can not be reduced due to the varying spring force of the dial washer 120.

Third Embodiment

A third embodiment of the present invention will hereinafter be described with reference to the drawings.

Figure 5:
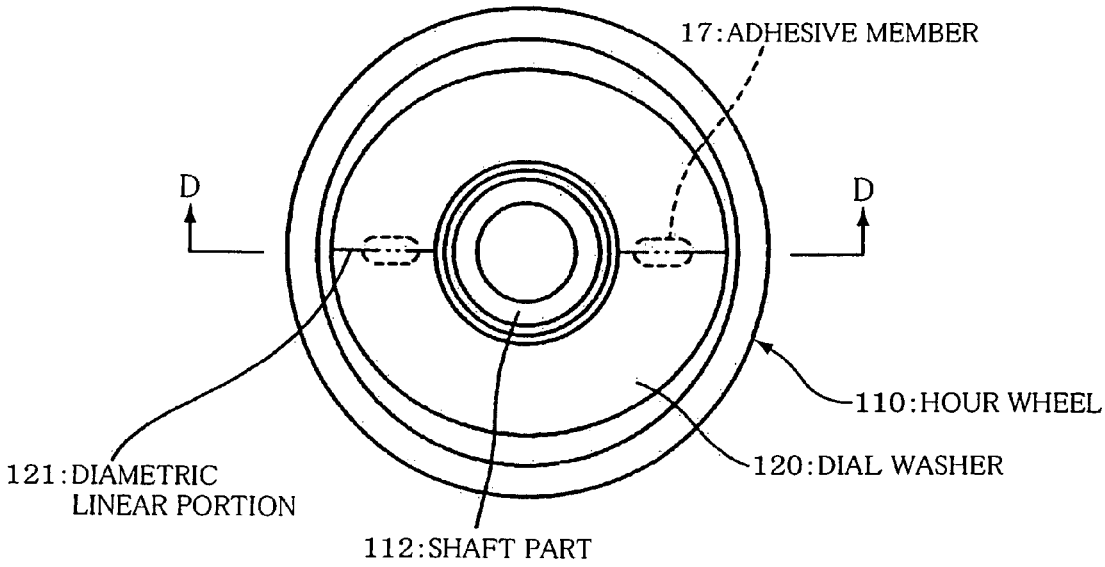
FIG. 5 is a schematic diagram of essential parts of a pointer indication type timepiece according to a third embodiment of the present invention, wherein (a) shows a plan view, and (b) shows a D-D sectional view.
Figure 5:
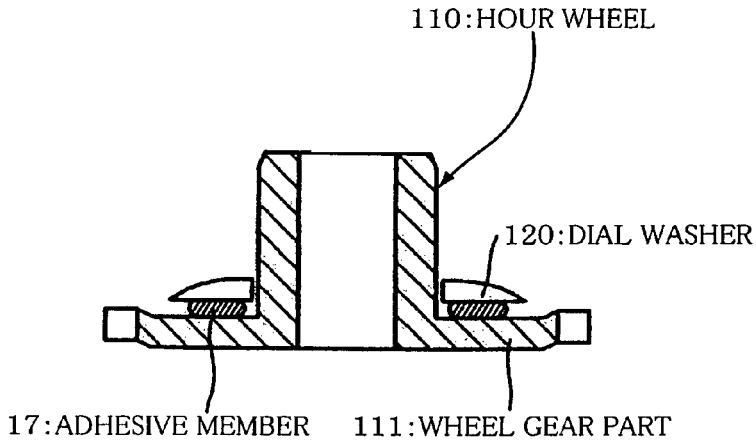

FIG. 5 is a schematic diagram of essential parts of a pointer indication type timepiece according to a third embodiment of the present invention, wherein (a) shows a plan view, and (b) shows a D-D sectional view.

In FIG. 5, the pointer indication type timepiece in the present embodiment is different from the pointer indication type timepiece in the second embodiment in that adhesive members 17 are used instead of hooks 16. Other components are substantially similar to those in the second embodiment.

Therefore, in FIG. 5, the same signs are assigned to the components similar to those in FIG. 4, and these components are not described in detail.

The adhesive members 17 are regulation members for regulating the axial movement of a dial washer 120, and fixes a diametric linear portion 121 of the dial washer 120 onto the upper surface of a wheel gear part 111. Thus, when the regulation members are the adhesive members 17, the dial washer 120 can also be easily fixed simply by pressing the dial washer 120 onto the adhesive members 17 provided on the upper surface of the wheel gear part 111 of an hour wheel 110.

Furthermore, the adhesive members 17 are provided at two places opposite to each other across a shaft part 112, such that the dial washer 120 can be fixed simply by the force of adhesion to the adhesive members 17 at the two places opposite to each other across the shaft part 112.

As described above, the dial washer 120 is bent using the arbitrary diametric linear portion 121 as a bottom, and two places of the bottom opposite to each other across the shaft part 112 are in contact with the adhesive members 17 to fix the dial washer 120. Thus, when the dial washer 120 is bent, the dial washer 120 can have a great amount of spring characteristics, and the dial washer 120 can be fixed at the bottom of the bent surface, such that the dial washer 120 is firmly fixed. Moreover, since the upward curve of the dial washer 120 is not inhibited, the variation of the spring force of the dial washer 120 is reduced, and the axial movement of the hour wheel 110 can be suppressed to reduce the deflection of handles.

Thus, according to the pointer indication type timepiece in the present embodiment, the adhesive members 17 are provided on the upper surface of the wheel gear part 111 of the hour wheel 110, such that the dial washer 120 can be prevented from dropping. Moreover, the production of foreign objects is suppressed, and the fixing of the pointers can be ensured without damaging a pointer attachment position. Further, it is possible to avoid a problem that the deflection of the handles can not be reduced due to the varying spring force of the dial washer 120.

Fourth Embodiment

A fourth embodiment of the present invention will hereinafter be described with reference to the drawings.

Figure 6:
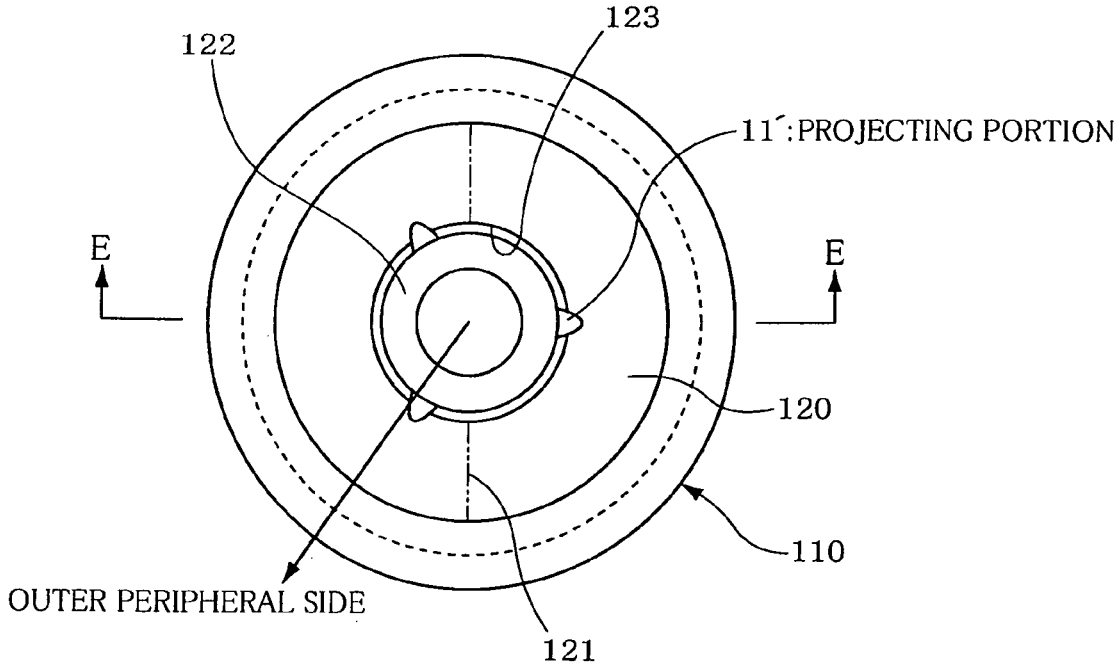
FIG. 6 is a schematic diagram of essential parts of a pointer indication type timepiece according to a fourth embodiment of the present invention, wherein (a) shows a plan view, and (b) shows an E-E sectional view.
Figure 6:
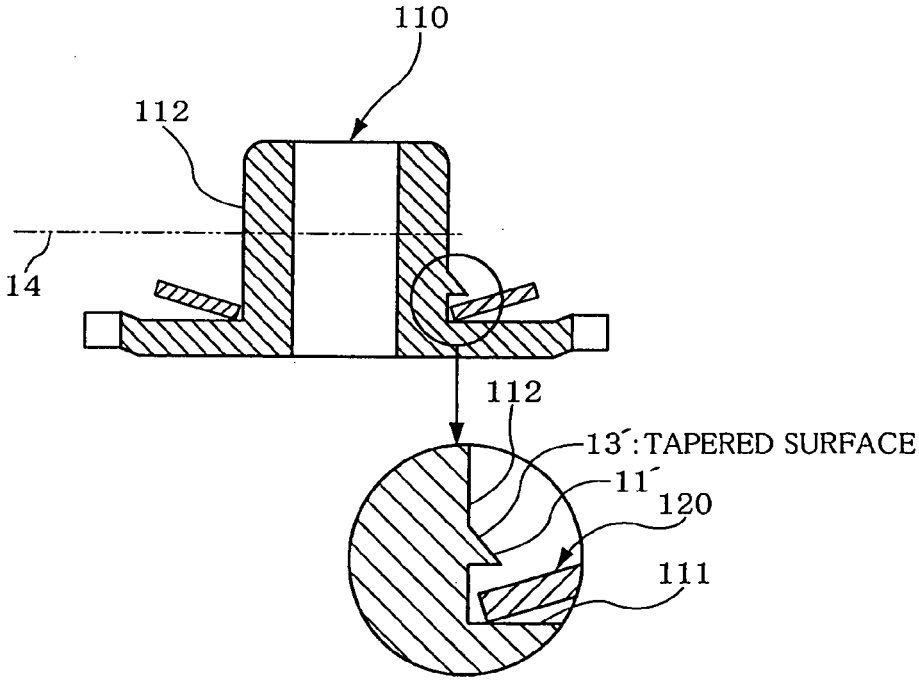

FIG. 6 is a schematic diagram of essential parts of a pointer indication type timepiece according to a fourth embodiment of the present invention, wherein (a) shows a plan view, and (b) shows an E-E sectional view.

In FIG. 6, the pointer indication type timepiece in the present embodiment is different from the pointer indication type timepiece in the first embodiment in that projecting portions 11' are formed at positions separate from the upper surface of a wheel gear part 111 of a shaft part 112 instead of projecting portions 11. Other components are substantially similar to those in the first embodiment.

Therefore, in FIG. 6, the same signs are assigned to the components similar to those in FIG. 1, and these components are not described in detail.

The projecting portions 11' project from the shaft part 112 to an outer peripheral side, and three projecting portions 11' are provided at equal intervals in the circumferential direction of the shaft part 112. Further, since the projecting portions 11' are formed at the positions separate from the upper surface of the wheel gear part 111 and therefore do not inhibit the upward curve of the dial washer 120, the variation of the spring force of the dial washer 120 is suppressed.

Here, the projecting portions 11' are preferably provided with tapered surfaces 13' at ends (upper ends in the present embodiment) corresponding to the longitudinal direction of the shaft part 112. Thus, the dial washer 120 can be smoothly inserted into the projecting portions 11'.

Furthermore, in a hour wheel 110, the diameter of a hypothetical circle (not shown) contacting the three projecting portions 11' is greater than the inside diameter of a circular hole 123, and the diameter of the shaft part 112 is smaller than the inside diameter of the circular hole 123. That is, the dial washer 120 idly engages between the projecting portions 11' and the wheel gear part 111 beyond the projecting portions 11'. Thus, the dial washer 120 idly engages with the shaft part 112, and the upward curve of the dial washer 120 is not inhibited, so that the spring force of the dial washer 120 does not vary, and it is possible to ensure that the axial movement of the hour wheel 110 can be suppressed to reduce the deflection of the handles.

According to the pointer indication type timepiece having such a configuration, the dial washer 120 idly engages with the shaft part 112, and the upward curve of the dial washer 120 is not inhibited, so that the spring force of the dial washer 120 does not vary, and it is possible to ensure that the axial movement of the hour wheel 110 can be suppressed to reduce the deflection of the handles.

Fifth Embodiment

A fifth embodiment of the present invention will hereinafter be described with reference to the drawings.

Figure 7:
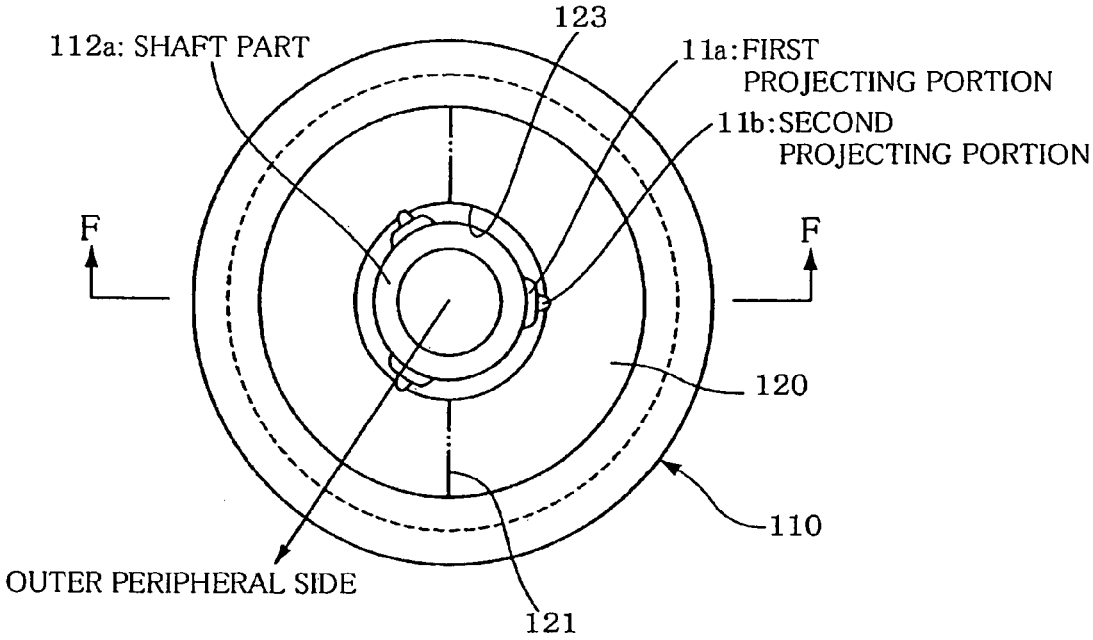
FIG. 7 is a schematic diagram of essential parts of a pointer indication type timepiece according to a fifth embodiment of the present invention, wherein (a) shows a plan view, and (b) shows an F-F sectional view.
Figure 7:
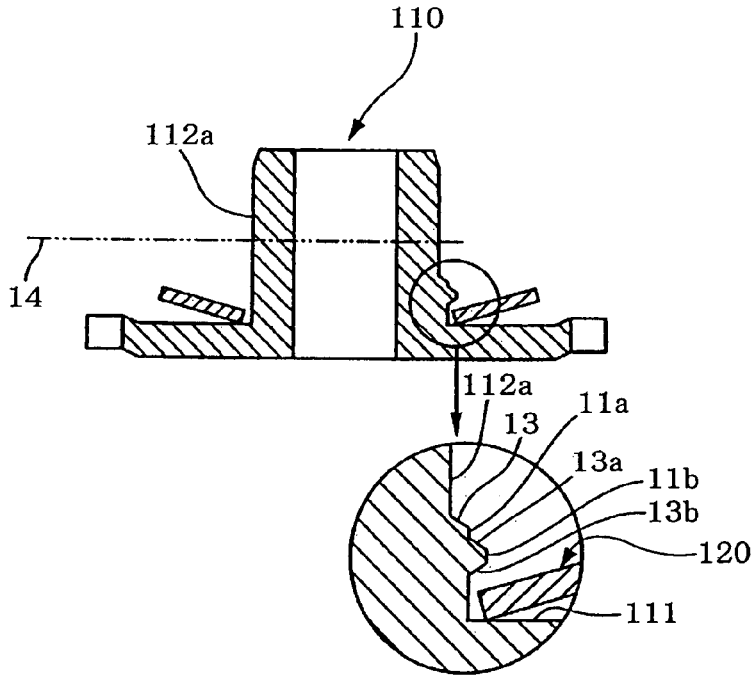

FIG. 7 is a schematic diagram of essential parts of a pointer indication type timepiece according to a fifth embodiment of the present invention, wherein (a) shows a plan view, and (b) shows an F-F sectional view.

In FIG. 7, the pointer indication type timepiece in the present embodiment is different from the pointer indication type timepiece in the first embodiment in that a first projecting portion 11*a* and a second projecting portion 11*b* are provided instead of a projecting portion 11. Other components are substantially similar to those in the first embodiment.

Therefore, in FIG. 7, the same signs are assigned to the components similar to those in FIG. 1, and these components are not described in detail.

The first projecting portion 11*a* projects from a shaft part 112*a* to an outer peripheral side, and has a structure substantially similar to that of the projecting portion 11 in the first embodiment. Then, the second projecting portion 11*b* further projects from the surface of the first projecting portion 11*a*, and is provided separately from a wheel gear part 111. Moreover, in the present embodiment, the first projecting portion 11*a* is formed to extend from the bottom surface of the second projecting portion 11*b* to the top of the surface of the wheel gear part 111. Thus, the amount of projection of the second projecting portion 11*b* from the first projecting portion 11*a* can be reduced, and the second projecting portion 11*b* can be produced by use of a molding die, that is, mold release is facilitated and ensured, thereby permitting a reduction in manufacturing costs.

Here, tapered surfaces 13 and 13*a* are preferably provided as tapered parts on tops of the first projecting portion 11*a* and the second projecting portion 11*b*. Thus, the dial washer 120 can be smoothly inserted into the first projecting portion 11*a* and the second projecting portion 11*b*, and the dial washer 120 can be easily attached. Moreover, a slope part 13*b* is preferably provided at the bottom of the second projecting portion 11*b*. Thus, when a hour wheel 110 is injection-molded, the completed hour wheel 110 can be easily released from the molding die owing to the slope part 13*b*. That is, the projecting portion has a two-stage structure composed of the first projecting portion 11*a* and the second projecting portion 11*b*, such that the height of the second projecting portion 11*b* from the first projecting portion 11*a* can be reduced, and the molding die can be more easily pulled out, thereby permitting the improvement of formability.

Figure 8:
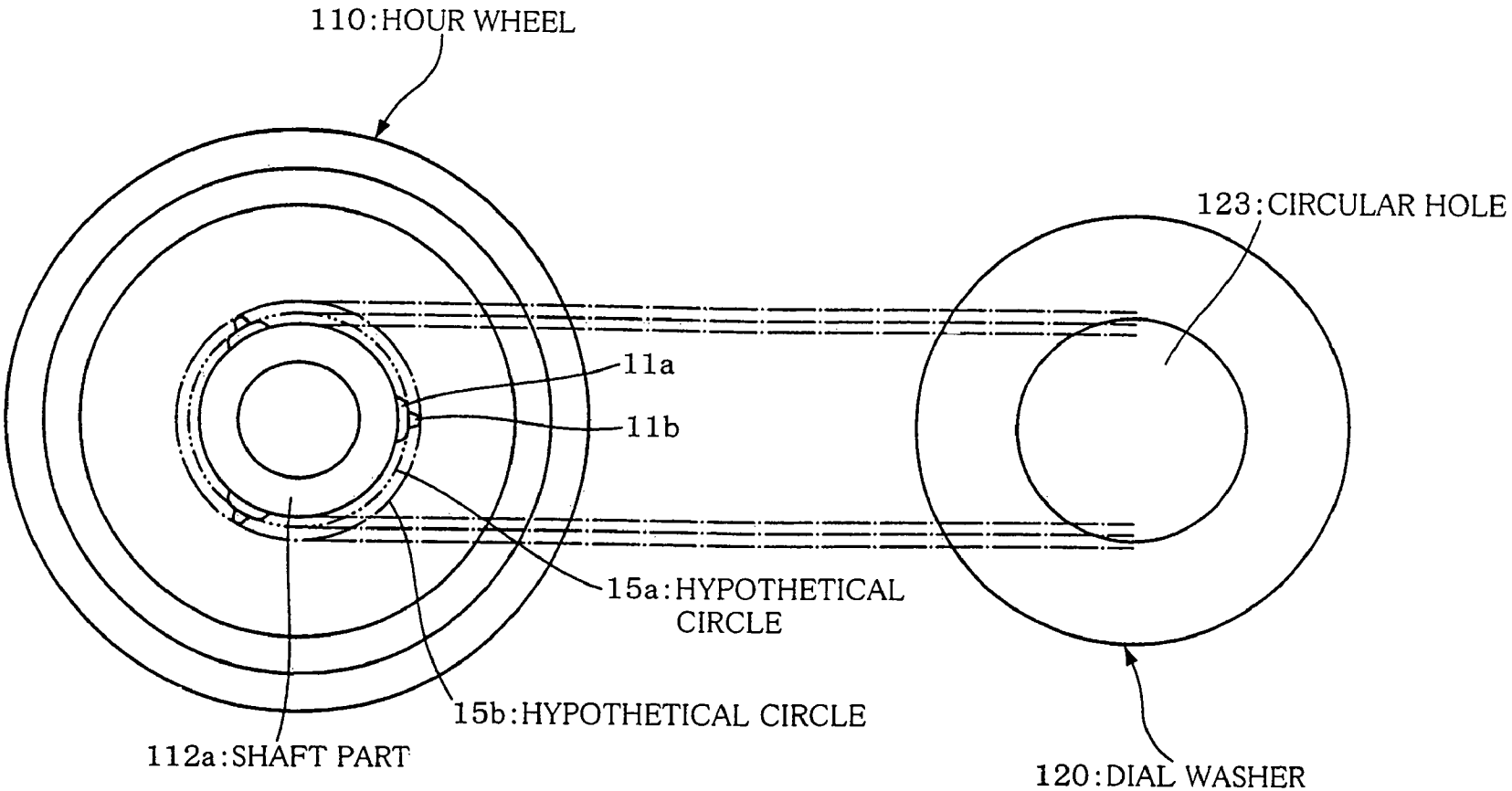
FIG. 8 shows a schematic enlarged plan view to explain the relation between projecting portions and a circular hole of a dial washer in the pointer indication type timepiece according to the fifth embodiment of the present invention.

FIG. 8 shows a schematic enlarged plan view to explain the relation between the projecting portions and a circular hole of the dial washer in the pointer indication type timepiece according to the fifth embodiment of the present invention.

In FIG. 8, in the hour wheel 110, the diameter of a hypothetical circle 15*b* contacting the three second projecting portions 11*b* is greater than the inside diameter of a circular hole 123, and the diameter of a hypothetical circle 15*a* contacting the three first projecting portions 11*a* is smaller than the inside diameter of the circular hole 123. That is, the dial washer 120 idly engages with the first projecting portion 11*a* between the second projecting portion 11*b* and the wheel gear part 111 beyond the second projecting portion 11*b*. Thus, the axial position of the dial washer 120 is regulated between the second projecting portion 11*b* and the wheel gear part 111, and it is possible to ensure the prevention of a problem that the dial washer 120 drops from the hour wheel 110. Moreover, when the dial washer 120 is inserted into the shaft part 112*a*, the dial washer 120 can be smoothly inserted into the shaft part 112*a* because a space between the shaft part 112*a* without the projecting portions 11*a* and 11*b* and the circular hole 123 of the dial washer 120 can be increased.

According to the pointer indication type timepiece having such a configuration, the dial washer 120 idly engages with the shaft part 112*a* (the first projecting portion 11*a*), and the upward curve of the dial washer 120 is not inhibited, so that the spring force of the dial washer 120 does not vary, and it is possible to ensure that the axial movement of the hour wheel 110 can be suppressed to reduce the deflection of the handles.

While the pointer indication type timepiece of the present invention has been described above in connection with the preferred embodiments, it should be understood that the pointer indication type timepiece according to the present invention is not exclusively limited to the embodiments described above, and various modifications can be made within the scope of the present invention.

For example, in the second and third embodiments, the projecting portions 11 are not formed in the shaft part 112, but the projecting portions 11 may be formed in the shaft part 112, which permits the dial washer 120 to be positioned in a more reliable manner.

INDUSTRIAL APPLICABILITY

As described above, a pointer indication type timepiece of the present invention is not limited to an assembled pointer indication type timepiece, and the present invention can also be effectively applied to, for example, a timepiece movement in the process of assembly.

The invention claimed is:

1. A pointer indication type timepiece comprising:

an hour wheel having a shaft part to which pointers are attached and a wheel gear part;

a dial washer for urging the wheel gear part to a main plate, said dial washer having a hole part through which the shaft part of the hour wheel is inserted; and regulation members provided in parts of the hour wheel, said regulation members regulating an axial movement of the dial washer to prevent the dial washer from slipping out of the shaft part of the hour wheel, wherein the regulation members comprise a plurality of projecting portions projecting from the shaft part to an outer peripheral side thereof.

2. The pointer indication type timepiece according to claim 1, wherein each of the projecting portions is provided to extend from a top of a surface of the wheel gear part of the hour wheel to an axially upper portion of the shaft part, and engages with the hole part of the dial washer.

3. The pointer indication type timepiece according to claim 2, wherein each of the projecting portion is provided below a pointer attachment position of the shaft part.

4. The pointer indication type timepiece according to claim 2, wherein a tapered part is formed at a top of each of the projecting portions.

5. The pointer indication type timepiece according to claim 2, wherein an inside diameter of the hole part of the dial washer is greater than an outside diameter of the pointer attachment position of the shaft part and smaller than a diameter of a hypothetical circle of the projecting portions.

6. The pointer indication type timepiece according to claim 2, wherein three or more odd projecting portions are provided and arranged at equal intervals.

7. The pointer indication type timepiece according to claim 1, wherein the projecting portions are formed at positions separate from an upper surface of the wheel gear part of the shaft part.

8. The pointer indication type timepiece according to claim 7, wherein the projecting portions are provided below a pointer attachment position of the shaft part.

9. The pointer indication type timepiece according to claim 7, wherein a tapered part is formed at a top of each of the projecting portions.

10. The pointer indication type timepiece according to claim 7, wherein an inside diameter of the hole part of the dial washer is greater than an outside diameter of the shaft part and smaller than a diameter of a hypothetical circle of the projecting portions, such that the dial washer idly engages with the shaft part between the projecting portions and the wheel gear part beyond the projecting portions.

11. The pointer indication type timepiece according to claim 7, wherein three or more odd projecting portions are provided and arranged at equal intervals.

12. The pointer indication type timepiece according to claim 1, wherein each of the projecting portions has a first projecting portion projecting from a surface of the shaft part, and a second projecting portion further projecting from a surface of the first projecting portion.

13. The pointer indication type timepiece according to claim 12, wherein the first projecting portion and the second projecting portion are provided below a pointer attachment position of the shaft part.

14. The pointer indication type timepiece according to claim 12, wherein tapered parts are formed at tops of the first projecting portion and/or the second projecting portion.

15. The pointer indication type timepiece according to claim 12, wherein a slope part is provided at a bottom of the second projecting portion.

16. The pointer indication type timepiece according to claim 12, wherein an inside diameter of the hole part of the dial washer is greater than a diameter of a hypothetical circle of the first projecting portions and smaller than a diameter of a hypothetical circle of the second projecting portions.

17. The pointer indication type timepiece according to claim 1, wherein the hour wheel is made of a resin.

18. The pointer indication type timepiece according to claim 1, wherein the dial washer is made of a metal.

19. The pointer indication type timepiece according to claim 1, wherein the projecting portions are formed at positions separate from an upper surface of the wheel gear part and projecting radially outwardly from the shaft part.

20. A pointer indication type timepiece comprising:

an hour wheel having a shaft part to which pointers are attached and a wheel gear part;

a dial washer having a hole part through which the shaft part of the hour wheel is inserted; and regulation members which regulate the axial movement of the dial washer, provided in parts of the hour wheel, wherein the regulation members are projecting portions projecting from the shaft part to an outer peripheral side thereof, wherein each of the projecting portions has a first projecting portion projecting from a surface of the shaft part, and a second projecting portion further projecting from a surface of the first projecting portion, and wherein three or more odd first projecting portions and three or more odd second projecting portions are provided and arranged at equal intervals.

21. A pointer indication type timepiece comprising:

an hour wheel having a shaft part to which pointers are attached and a wheel gear part;

a dial washer having a hole part through which the shaft part of the hour wheel is inserted, and regulation members including projecting portions which regulate an axial movement of the dial washer provided in parts of the hour wheel;

wherein each of the projecting portions has a first projecting portion projecting from a surface of the shaft part, and a second projecting portion further projecting from a surface of the first projecting portion, the first projecting portion being formed to extend from a bottom surface of the second projecting portion to a top of a surface of the wheel gear part.

22. The pointer indication type timepiece according to claim 21, wherein an inside diameter of the hole part of the dial washer is greater than a diameter of a hypothetical circle of the first projecting portions and smaller than a diameter of a hypothetical circle of the second projecting portions.

23. The pointer indication type timepiece according to claim 21, wherein tapered parts are formed at tops of the first projecting portion and/or the second projecting portion, and a slope part is provided at a bottom of the second projecting portion.

* * * * *